US009837233B2

(12) United States Patent
Gu et al.

(10) Patent No.: US 9,837,233 B2
(45) Date of Patent: Dec. 5, 2017

(54) ROTATING DUAL BREAK POINT CONTACT

(71) Applicants: SEARI ELECTRIC TECHNOLOGY CO., LTD., Shanghai (CN); ZHEJIANG CHINT ELECTRICS CO., LTD., Yueqing (CN)

(72) Inventors: Xiang Gu, Shanghai (CN); Yi Liu, Shanghai (CN); Zhongbin Wang, Shanghai (CN)

(73) Assignees: SEARI ELECTRIC TECHNOLOGY CO., LTD., Shanghai (CN); ZHEJIANG CHINT ELECTRICS CO., LTD., Yueqing (CN)

( * ) Notice: Subject to any disclaimer, the term of this patent is extended or adjusted under 35 U.S.C. 154(b) by 34 days.

(21) Appl. No.: 15/024,336

(22) PCT Filed: Sep. 19, 2014

(86) PCT No.: PCT/CN2014/086919

§ 371 (c)(1),
(2) Date: Mar. 23, 2016

(87) PCT Pub. No.: WO2015/043423

PCT Pub. Date: Apr. 2, 2015

(65) Prior Publication Data

US 2016/0233043 A1 Aug. 11, 2016

(30) Foreign Application Priority Data

Sep. 24, 2013 (CN) ..... 2013 1 0459310

(51) Int. Cl.
*H01H 1/12* (2006.01)
*H01H 71/10* (2006.01)
(Continued)

(52) U.S. Cl.
CPC ..... *H01H 71/1009* (2013.01); *H01H 1/205* (2013.01); *H01H 1/2041* (2013.01);
(Continued)

(58) Field of Classification Search
CPC ..... H01H 71/1009; H01H 71/1045; H01H 73/041; H01H 33/022; H01H 33/60; H01H 33/42; H01H 33/53
(Continued)

(56) References Cited

U.S. PATENT DOCUMENTS 5,504,467 A 4/1996 McColloch et al.
2001/0045879 A1* 11/2001 Reichard ..... H01H 77/02 335/172
(Continued)

FOREIGN PATENT DOCUMENTS

CN 1819095 A 8/2006
CN 101320659 A 12/2008
(Continued)

OTHER PUBLICATIONS

International Search Report issued in PCT/CN2014/086919 dated Dec. 10, 2014 (2 pages).
(Continued)

*Primary Examiner* — Shawki S Ismail
*Assistant Examiner* — Lisa Homza
(74) *Attorney, Agent, or Firm* — Osha Liang LLP

(57) ABSTRACT

A rotating dual break point contact includes a rotor support, a first shaft, a second shaft, a third shaft, a first connection rod, a second connection rod, a contact bridge and a contact spring. The contact bridge is provided in the rotor support, and the contact bridge rotates relative to the rotor support by means of the first shaft, the second shaft, the third shaft, the first connection rod and the second connection rod. The contact bridge rotates between an initial pressure position and a maximum repulsion position. A single contact spring is mounted on one side of the contact bridge and is located in the rotor support.

18 Claims, 9 Drawing Sheets

(51) Int. Cl.
*H01H 1/20* (2006.01)
*H01H 73/04* (2006.01)

(52) U.S. Cl.
CPC ..... *H01H 1/2058* (2013.01); *H01H 71/1027* (2013.01); *H01H 71/1045* (2013.01); *H01H 73/045* (2013.01); *H01H 2071/1036* (2013.01); *H01H 2235/01* (2013.01)

(58) Field of Classification Search
USPC ..... 335/200
See application file for complete search history.

(56) References Cited

U.S. PATENT DOCUMENTS

| | | | | |
|---|---|---|---|---|
| 2006/0077022 | A1 | 4/2006 | Kim | |
| 2007/0075808 | A1* | 4/2007 | Ahn | H01H 71/1009 335/6 |
| 2016/0233038 | A1* | 8/2016 | Liu | H01H 1/2058 |

FOREIGN PATENT DOCUMENTS

| | | | | |
|---|---|---|---|---|
| CN | 201302964 | Y | 9/2009 | |
| CN | 103050344 | A | 4/2013 | |
| DE | 19933919 | A1 | 1/2001 | |
| DE | 10 2008 037 967 | A1 | 2/2010 | |
| EP | 2768005 | A1 * | 8/2014 | H01H 1/2058 |

OTHER PUBLICATIONS

Written Opinion of the International Searching Authority issued in PCT/CN2014/086919 dated Dec. 10, 2014 (4 pages).
Official Action and Search Report dated Jan. 25, 2016, by the State Intellectual Property Office of the People's Republic of China in related Chinese Patent Application No. CN 2013104593105, with English translation of the Search Report only (11 pages).
EPO Communication (Office Action) with Extended European Search Report dated Mar. 17, 2017, issued by the European Patent Office in corresponding European Patent Application No. EP-14849372.9 (7 pages).

* cited by examiner

ROTATING DUAL BREAK POINT CONTACT

CROSS REFERENCE TO RELATED APPLICATIONS

This is a national stage application based on PCT/US2014/086919, filed on Sep. 19, 2014, which claims the priority of Chinese Patent Application No. 201310459310.5, filed on Sep. 24, 2013. This application claims the benefit and priority of these prior applications and incorporates their disclosures by reference in their entirety.

BACKGROUND OF THE INVENTION

1. Field of the Invention

The present invention relates to contact structure of a circuit breaker, more particularly, relates to a moving contact module in a circuit breaker.

2. The Related Art

Dual break point form is a trend of molded case circuit breakers. Contact module is an important part of a molded case circuit breaker and has drawn attention in the field. Modern molded case circuit breakers with high breaking capability mainly use rotating dual break point contacts. The rotating dual break point contacts have a lot of different structures. Some products also provide additional functions such as a lock function to lock the contact after the contact is repulsed by an electro-dynamic repulsion force, so that the contact will not rebound back.

The Chinese patent application with the application number CN201110310339.8 discloses a rotating dual break point moving contact module. The moving contact may open quickly under large short circuit current, the moving contact will be locked after opening and will not rebound. The moving contact module also keeps balance of contact pressure on different sides. The rotating dual break point moving contact module disclosed in CN201110310339.8 has two contact springs. The two contact springs are arranged on both sides of the contact module so that the width dimension of the module is large. The large width dimension is unfavorable to miniaturization, especially when a plurality of contact modules need to be cascaded to form a multi-phase contact module, the width dimension will be a key parameter that may affect the overall volume of the multi-phase contact module.

SUMMARY

The present invention provides a rotating dual break point contact with a compact structure and small volume.

According to an embodiment of the present invention, a rotating dual break point contact is provided. The contact comprises a rotor support, a first shaft, a second shaft, a third shaft, a first connection rod, a second connection rod, a contact bridge and a contact spring. The contact bridge is provided in the rotor support, the contact bridge rotates relative to the rotor support by means of the first shaft, the second shaft, the third shaft, the first connection rod and the second connection rod. The contact bridge rotates between an initial pressure position and a maximum repulsion position. A single contact spring is mounted on one side of the contact bridge and is located in the rotor support.

The rotor support is single phase independent. The rotor support comprises two side plates and two lateral shafts which connect the two side plates, the two side plates are uniform in shape and size. The two side plates have a gap therebetween which is sufficient for the contact bridge to pass through. The two lateral shafts are centrosymmetric. Each side plate is provided with a central hole in the center, each side plate is provided with a pair of centrosymmetric linkage holes and a pair of centrosymmetric connection slots. The pair of linkage holes are disposed on two ends of the major axis of the side plate respectively, and the pair of the connection slots are disposed on two ends of the minor axis of the side plate respectively.

Two first connection rods are mounted between the two side plates and are arranged on different sides of the contact bridge. The first connection rod is provided with a short shaft, the short shaft is mounted in the connection slot, the short shaft is the rotation center of the first connection rod.

Two second connection rods are mounted between the two side plates and are arranged on different sides of the contact bridge.

The contact bridge is centrosymmetric in cross section. The contact bridge is provided with an obround hole in the center, the first shaft passes through the obround hole and slides therein along a longitudinal direction of the obround hole. The first shaft is the rotation center of the contact bridge when the first shaft slides to one end of the obround hole. The contact bridge is provided with a pair of centrosymmetric curved surfaces and a pair of centrosymmetric through holes. Two curved surfaces cooperate with two lateral shafts to constrain the rotation range of the contact bridge. Two third shafts pass through two through holes respectively. The contact bridge is provided with two contact points on each side, the two contact points are welded to a contact. The longitudinal direction of the obround hole and a line connecting the two contact points form an included angle, the included angle keeps balance of the contact pressure of the contact points on both sides of the contact bridge.

The first shaft passes through the obround hole on the contact bridge and the central hole on the side plate.

Two second shafts respectively pass through the first connection rod and the second connection rod and are mounted on profile of the two side plates, the two second shafts are arranged centrosymmetrically.

Two third shafts respectively pass through the through hole on the contact bridge and the second connection rod. The two third shafts are arranged centrosymmetrically.

Two ends of the single contact spring are mounted on two second shafts respectively.

According to an embodiment, the central holes on the two side plates are aligned, the linkage holes on the two side plates are aligned, the connection slots on the two side plates are aligned. The first shaft cooperates with the central hole by means of a minuteness gap.

According to an embodiment, a cylindrical surface on the lateral shaft cooperates with the curved surface on the contact bridge, two lateral shafts correspond to the initial pressure position and the maximum repulsion position of the contact bridge respectively, the cylindrical surface on the lateral shaft cooperates with the curved surface by means of a minuteness gap.

According to an embodiment, the first connection rod comprises a body and two terminal surfaces laterally extending from both ends of the body. Each terminal surface is provided with a convex short shaft and a first shaft hole, the short shaft and the first shaft hole are symmetric about the body on the terminal surface. The short shaft cooperates with the connection slot by means of a minuteness gap.

According to an embodiment, the second connection rod comprises a body and two terminal surfaces laterally extending from both ends of the body. Each terminal surface is provided with a second shaft hole and a third shaft hole. The second shaft hole and the third shaft hole are symmetric about the body on the terminal surface.

According to an embodiment, the side plate is provided with a groove slot. The second shaft passes through the first shaft hole on the first connection rod and the second shaft hole on the second connection rod. The second shaft is mounted on the groove slot. The second shaft cooperates with the first shaft hole and the second shaft hole by means of minuteness gaps respectively.

According to an embodiment, the third shaft passes through the third shaft hole on the second connection rod. The third shaft cooperates with the third shaft hole by means of a minuteness gap.

According to an embodiment, the rotor support is provided with a connection rod slot and a spring slot on both side plates. A depth of the connection rod slot is not smaller than a thickness of the body of the first connection rod. The body enters into the connection rod slot when the first connection rod rotates, the contact spring is able to move in the spring slot.

According to an embodiment, a plurality of contact modules with the rotating dual break point contact are cascaded to form a multi-phase contact module. A linkage shaft is mounted in the linkage holes to realize linkage of the multi-phase contact module.

The rotating dual break point contact of the present invention has a simple structure and high reliability. The contact pressure on both sides of the contact bridge is balanced via an included angle between an obround hole and contact points. A single spring is utilized so that the rotating dual break point contact has a compact structure and small volume.

BRIEF DESCRIPTION OF THE DRAWINGS

The above and other features, natures, and advantages of the invention will be apparent by the following description of the embodiments incorporating the drawings, wherein.

DETAILED DESCRIPTION OF EMBODIMENTS

Figure 1:
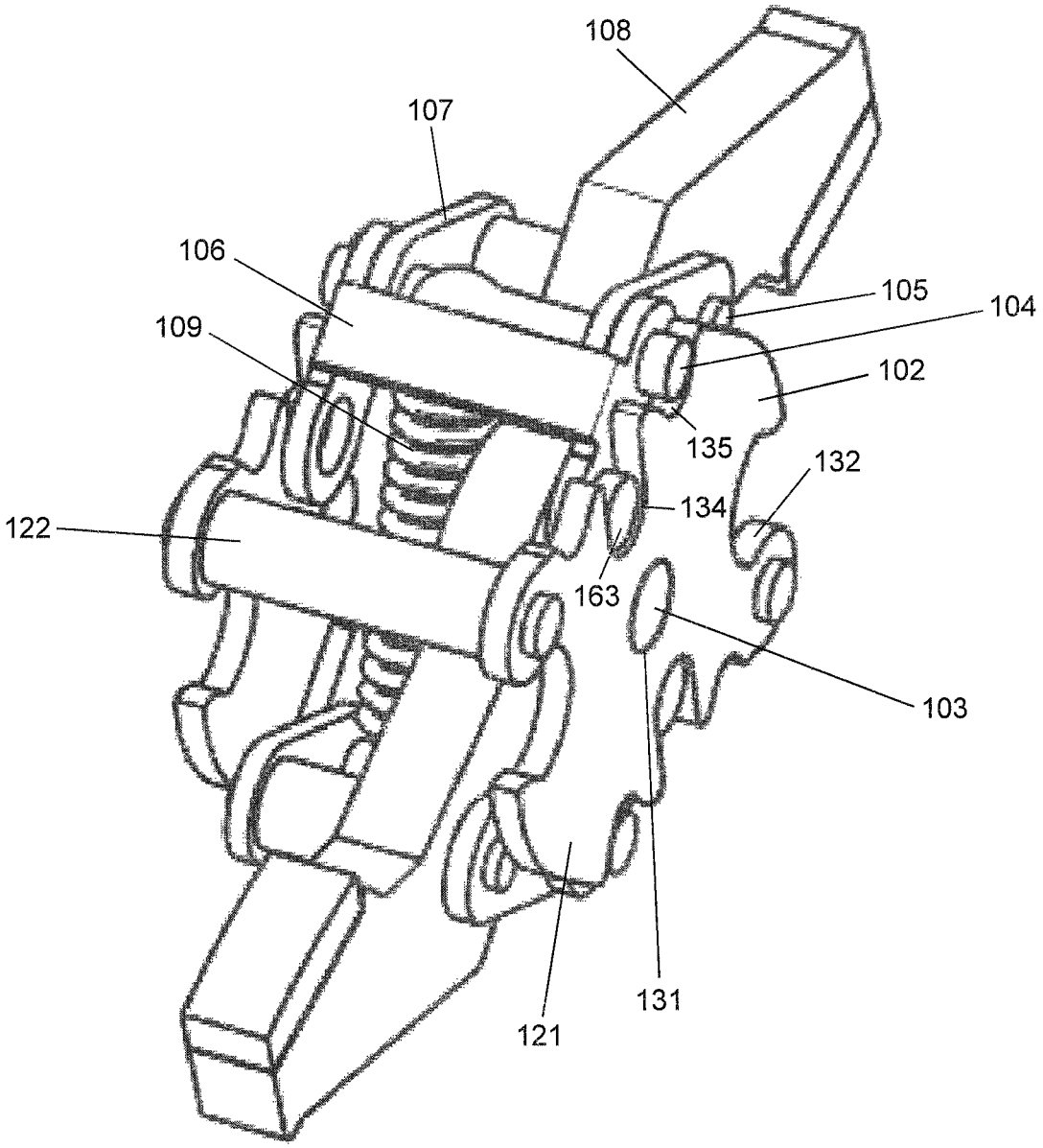
FIG. 1 illustrates an assembling structure diagram of a rotating dual break point contact according to an embodiment of the present invention.

The Chinese application with the application number CN201110310339.8 was also filed by the applicant of the present application. The present invention is carried out based on CN201110310339.8, with miniaturized volume and simplified structure. The present invention discloses a repulsion and lock apparatus with less components, simpler structure and higher reliability. When a contact bridge is repulsed with a small angle by an electro-dynamic repulsion force, a lock component may quickly lock the contact bridge at a maximum repulsion position. Another problem that a rotating dual break point contact shall face to is to keep balance of contact pressure on different sides of the contact bridge. The present invention may increase the stability of the pressure balance between the contacts on different sides of the contact bridge, while maintaining the contact pressure at a desired level. The basic operating principle of the present invention is similar to CN201110310339.8 and the basic operating principle will not be repeatedly described here. A difference between the present invention and CN201110310339.8 is that the present invention utilizes a single contact spring. Single contact spring structure may significantly reduce the dimension of width of the structure. The saved space may be used to thicken shells of a circuit breaker so as to increase mechanical strength, therefore breaking reliability of the circuit breaker is enhanced. Single contact spring structure may also reduce volume of the circuit breaker to realize a miniaturized product. A single contact spring may be disposed within a rotor support, which may prevent the contact spring from damage of arc or metal particles.

The present invention provides a rotating dual break point contact. The contact comprises: a rotor support 102, a first shaft 103, a second shaft 104, a third shaft 105, a first connection rod 106, a second connection rod 107, a contact bridge 108 and a contact spring 109. The contact bridge 108 is provided in the rotor support 102. The contact bridge 104 rotates relative to the rotor support 102 by means of the first shaft 103, the second shaft 104, the third shaft 105, the first connection rod 106 and the second connection rod 107. The contact bridge 108 rotates between an initial pressure position and a maximum repulsion position. A single contact spring 109 is mounted on one side of the contact bridge 108 and is located in the rotor support 102.

As shown in FIG. 1, FIG. 1 illustrates an assembling structure diagram of a rotating dual break point contact according to an embodiment of the present invention. The rotor support 102 is single phase independent. The rotor support 102 comprises two side plates 121 and two lateral shafts 122 which connect the two side plates. The two side plates 121 are uniform in shape and size, the two side plates 121 have a gap therebetween which is sufficient for the contact bridge 108 to pass through. The two lateral shafts 122 are centrosymmetric. Each side plate is provided with a central hole 131 in the center, each side plate is provided with a pair of centrosymmetric linkage holes 132 and a pair of centrosymmetric connection slots 134. The pair of linkage holes 132 are disposed on two ends of the major axis of the side plate respectively, and the pair of the connection slots 134 are disposed on two ends of the minor axis of the side plate respectively. The central holes 131 on the two side plates 121 are aligned, the linkage holes 132 on the two side plates 121 are aligned, and the connection slots 134 on the two side plates 121 are aligned, so that the shafts may pass through the holes or slots.

Figure 3:
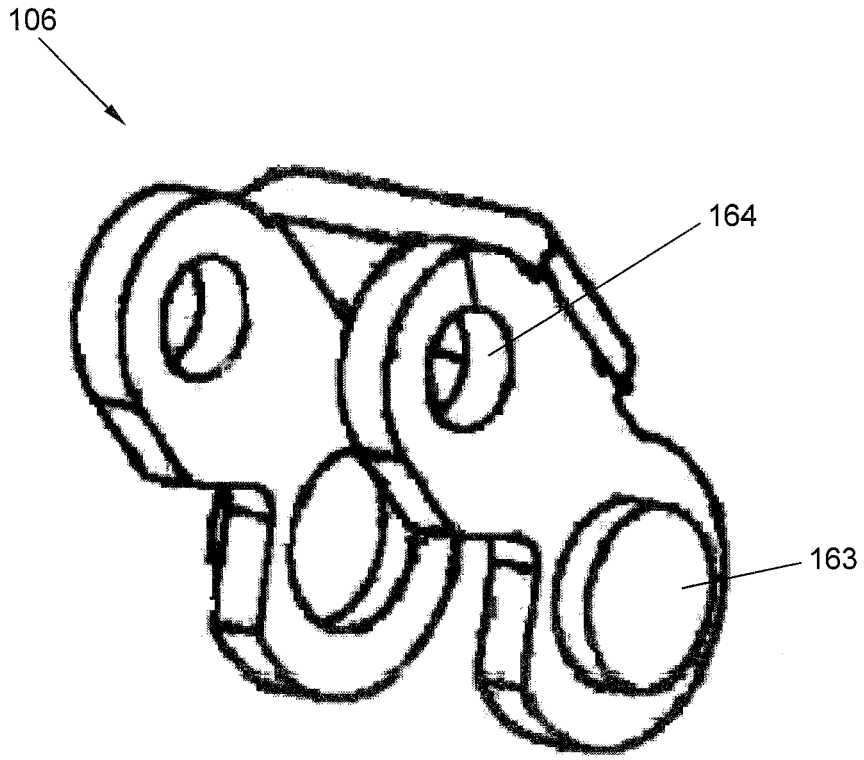
FIG. 3 illustrates the structure of a first connection rod in a rotating dual break point contact according to an embodiment of the present invention.

Two first connection rods 106 are mounted between the two side plates 121 and are arranged on different sides of the contact bridge 108. The first connection rod 106 is provided with a short shaft 163, which is mounted in the connection slot 134. The short shaft 163 is the rotation center of the first connection rod 106. FIG. 3 illustrates the structure of a first connection rod in a rotating dual break point contact according to an embodiment of the present invention. The first connection rod 106 comprises a body and two terminal surfaces laterally extending from both ends of the body. Each terminal surface is provided with a convex short shaft 163 and a first shaft hole 164. The short shaft 163 and the first shaft hole 164 are symmetric about the body on the terminal surface. The short shaft 163 cooperates with the connection slot 134 by means of a minuteness gap. The rotor support 102 is provided with a connection rod slot and a spring slot on both side plates 121. A depth of the connection rod slot is not smaller than a thickness of the body of the first connection rod 106. The body enters into the connection rod slot when the first connection rod 106 rotates.

Figure 4:
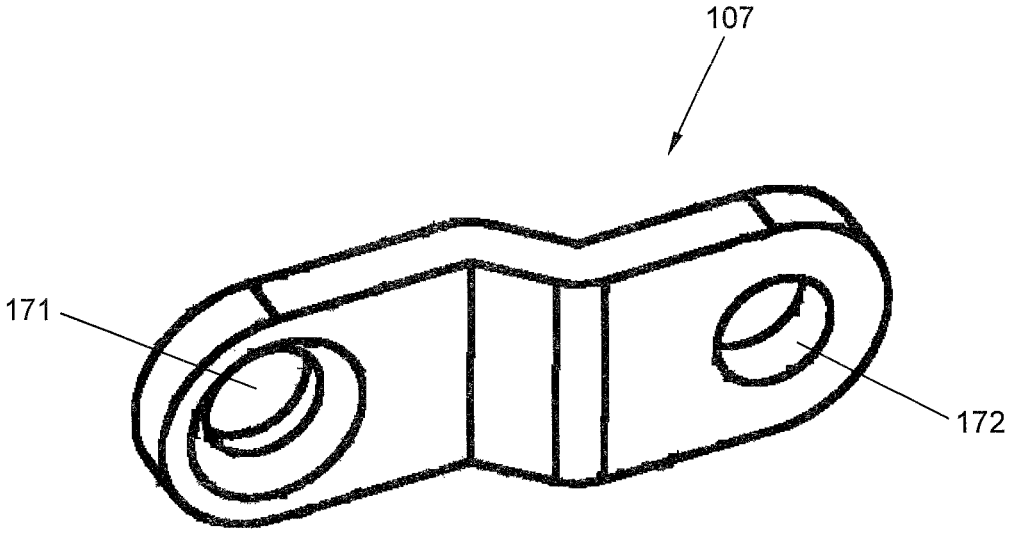
FIG. 4 illustrates the structure of a second connection rod in a rotating dual break point contact according to an embodiment of the present invention.

Two second connection rods 107 are mounted between the two side plates 121 and are arranged on different sides of the contact bridge 108. FIG. 4 illustrates the structure of a second connection rod in a rotating dual break point contact according to an embodiment of the present invention. The second connection rod 107 comprises a body and two terminal surfaces laterally extending from both ends of the body. Each terminal surface is provided with a second shaft hole 171 and a third shaft hole 172. The second shaft hole 171 and the third shaft hole 172 are symmetric about the body on the terminal surface.

Figure 2:
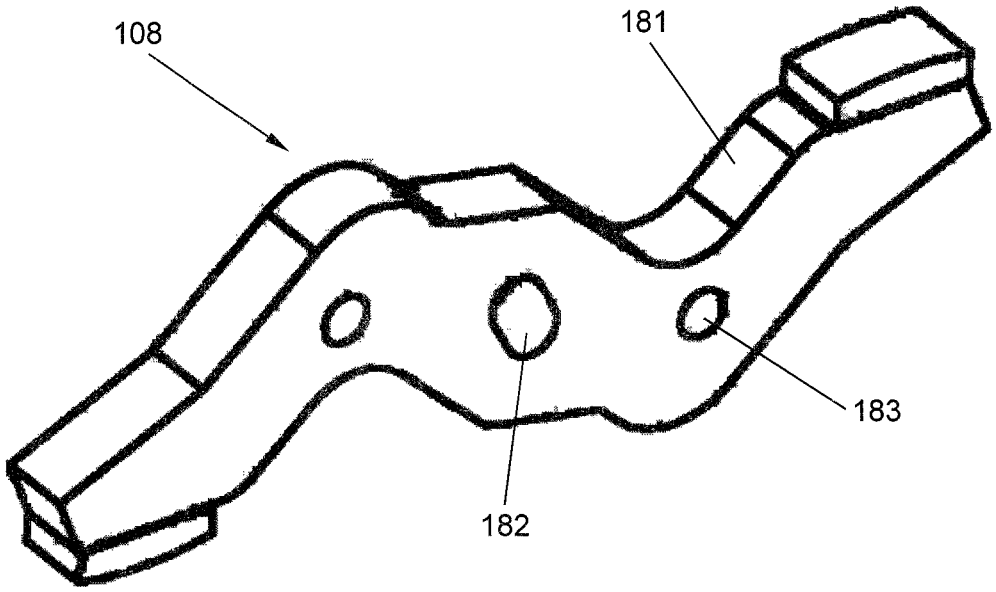
FIG. 2 illustrates the structure of a contact bridge in a rotating dual break point contact according to an embodiment of the present invention.

The contact bridge 108 is centrosymmetric in cross section. The contact bridge is provided with an obround hole 182 in the center, the first shaft 103 passes through the obround hole 182 and slides therein along a longitudinal direction of the obround hole. The first shaft 103 is the rotation center of the contact bridge 108 when the first shaft 103 slides to one end of the obround hole. The contact bridge is provided with a pair of centrosymmetric curved surfaces 181 and a pair of centrosymmetric through holes 183. Two curved surfaces 181 cooperate with two lateral shafts 122 to constrain the rotation range of the contact bridge 108. Two third shafts 105 pass through two through holes 183 respectively. The contact bridge 108 is provided with two contact points on each side, the two contact points are welded to a contact. The longitudinal direction of the obround hole 182 and a line connecting the two contact points form an included angle, which keeps balance of the contact pressure of the contact points on both sides of the contact bridge 108. FIG. 2 illustrates the structure of a contact bridge in a rotating dual break point contact according to an embodiment of the present invention. A cylindrical surface on the lateral shaft 122 cooperates with the curved surface 181 on the contact bridge 108. Two lateral shafts 122 correspond to the initial pressure position and the maximum repulsion position of the contact bridge 108 respectively. The cylindrical surface on the lateral shaft 122 cooperates with the curved surface 181 by means of a minuteness gap.

The first shaft 103 passes through the obround hole 182 on the contact bridge 108 and the central hole 131 on the side plate 121. The first shaft 103 cooperates with the central hole 131 by means of a minuteness gap.

Two second shafts 104 respectively pass through the first connection rod 106 and the second connection rod 107 and are mounted on profile of the two side plates 121. The two second shafts 104 are arranged centrosymmetrically. The side plate 121 is provided with a groove slot 135. The second shaft 104 passes through the first shaft hole 164 on the first connection rod 106 and the second shaft hole 171 on the second connection rod 107. The second shaft 104 is mounted on the groove slot 135. The second shaft 104 cooperates with the first shaft hole 164 and the second shaft hole 171 by means of minuteness gaps respectively.

Two third shafts 105 respectively pass through the through hole 183 on the contact bridge and the second connection rod 107. The two third shafts 105 are arranged centrosymmetrically. The third shaft 105 passes through the third shaft hole 172 on the second connection rod 107. The third shaft 105 cooperates with the third shaft hole 172 by means of a minuteness gap.

Two ends of the single contact spring 109 are mounted on two second shafts 104 respectively. The rotor support 102 is further provided with a spring slot on both side plates 121. The contact spring 109 is able to move in the spring slot. It should be noted that, because only a single contact spring 109 is used in the present invention, the single contact spring 109 is arranged in one spring slot on one side plate 121. Both side plates 121 are provided with spring slots so that the arrangement of the contact spring is more flexible, and the contact spring may be arranged in either side.

Figure 5:
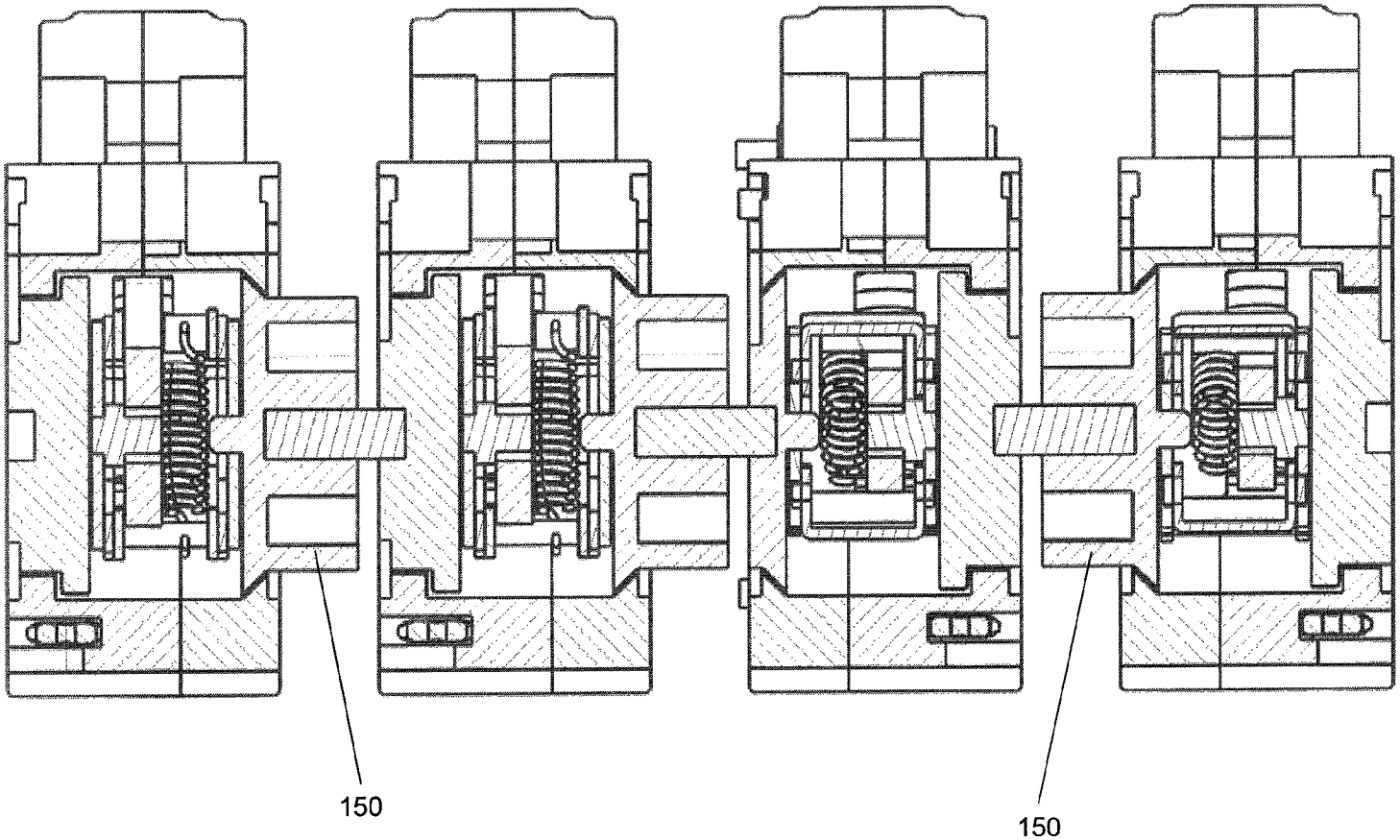
FIG. 5 illustrates a schematic diagram of a multi-phase contact module formed by cascading of a plurality of rotating dual break point contacts according to an embodiment of the present invention.

FIG. 5 illustrates a schematic diagram of a multi-phase contact module formed by cascading of a plurality of rotating dual break point contacts according to an embodiment of the present invention. As shown in FIG. 5, a plurality of contact modules with the described rotating dual break point contact are cascaded to form a multi-phase contact module. A linkage shaft 150 is mounted in the linkage holes 132 to realize linkage of the multi-phase contact module.

According to the embodiments of the present invention, the rotating dual break point contact utilizes a single spring structure so that the axial dimension of the spring structure is dramatically reduced. Then the axial dimension of the contact module shell and the linkage shaft may be increased so as to increase the overall strength of the contact module.

Figure 6:
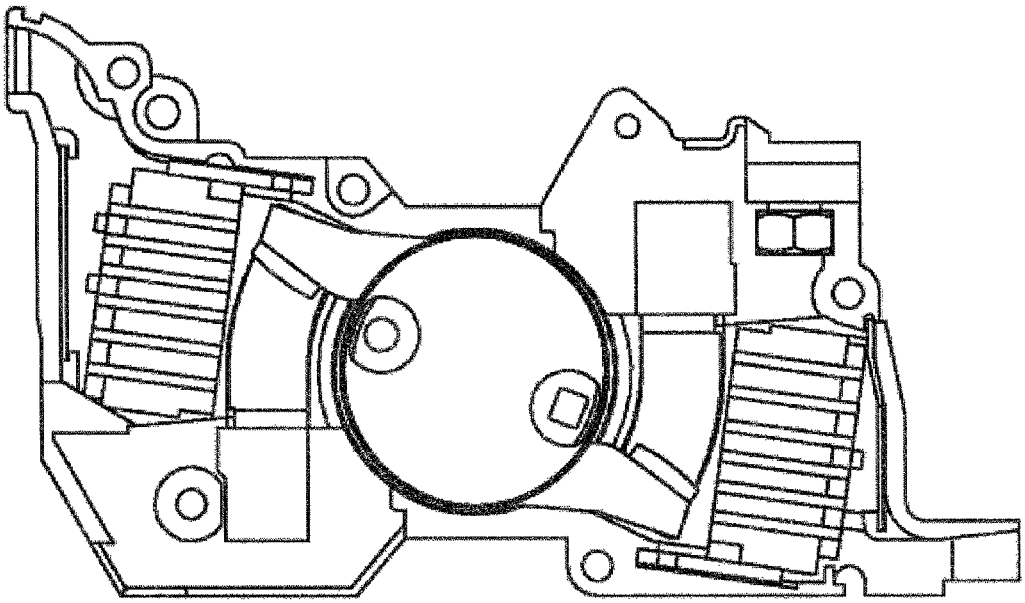
FIG. 6 illustrates a schematic diagram of a rotating dual break point contact according to an embodiment of the present invention, wherein a circuit breaker is at an open position or a release position.

The operating process and operating principle of the present invention are as follows: when a circuit break is at an open position, a mechanism formed by connection rods and shafts rotates clockwise under a spring force of the contact spring. The force is transferred to the first connection rod via the first shaft and the first shaft rotates clockwise. Meanwhile, the force is transferred to the contact bridge via a four rod linkage mechanism formed by the first connection rod, the second connection rod and the contact bridge. The contact bridge rotates clockwise and curved surface on the contact bridge contacts with the cylindrical surface on the lateral shaft of the rotor support. The circuit breaker is set to an open status. The circuit breaker shall have a similar status at a release position, so the release position will not be further described here. FIG. 6 illustrates a schematic diagram of a rotating dual break point contact according to an embodiment of the present invention, wherein a circuit breaker is at an open position or a release position.

Figure 7:
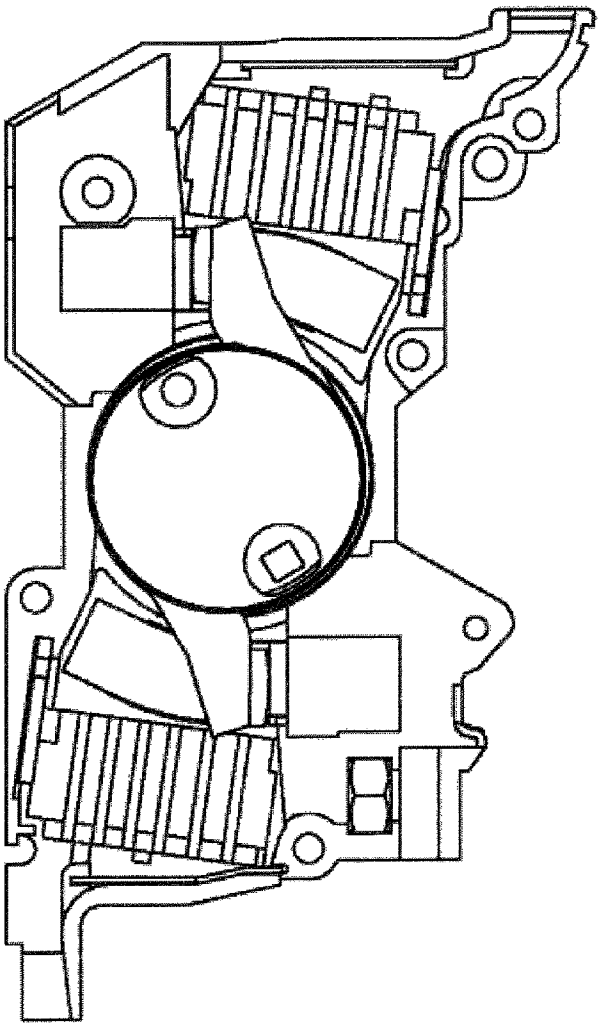
FIG. 7 illustrates a schematic diagram of a rotating dual break point contact according to an embodiment of the present invention, wherein a circuit breaker is at a close position.

When a circuit breaker is at a close position, the mechanism formed by connection rods and shafts rotates anti-clockwise under a spring force of the contact spring. The force is transferred to the first connection rod via the first shaft and the first shaft rotates anti-clockwise. Meanwhile, the force is transferred to the contact bridge via a four rod linkage mechanism formed by the first connection rod, the second connection rod and the contact bridge. The contact bridge rotates anti-clockwise and the contacts on the contact bridge (the moving contacts) contact with static contacts. FIG. 7 illustrates a schematic diagram of a rotating dual break point contact according to an embodiment of the present invention, wherein a circuit breaker is at a close position.

Figure 8:
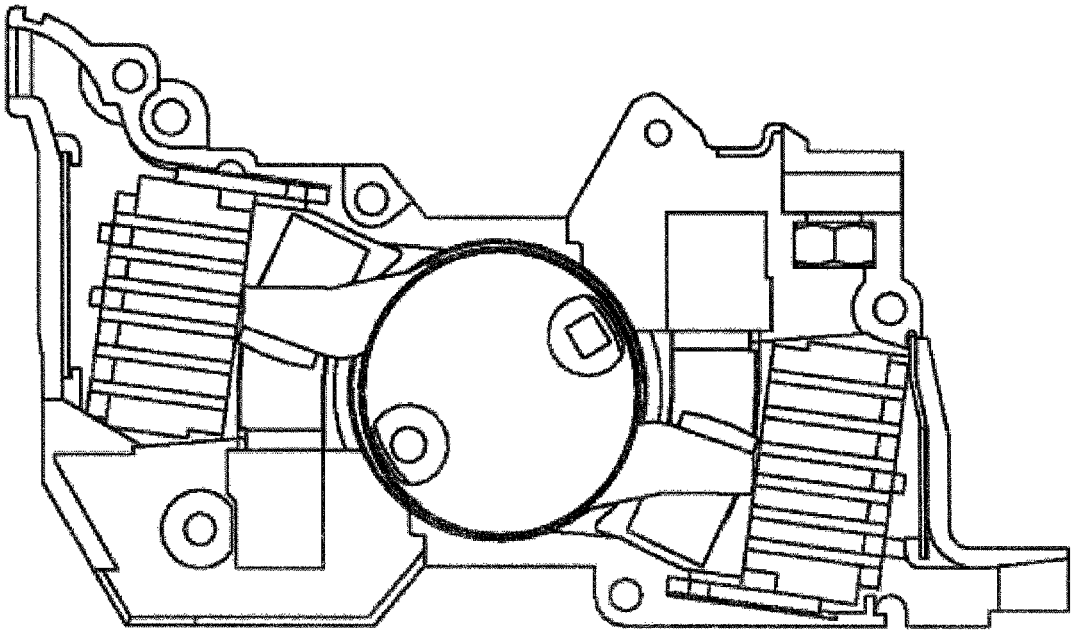
FIG. 8 illustrates a schematic diagram of a rotating dual break point contact according to an embodiment of the present invention, wherein a circuit breaker is at a dead point.
Figure 9:
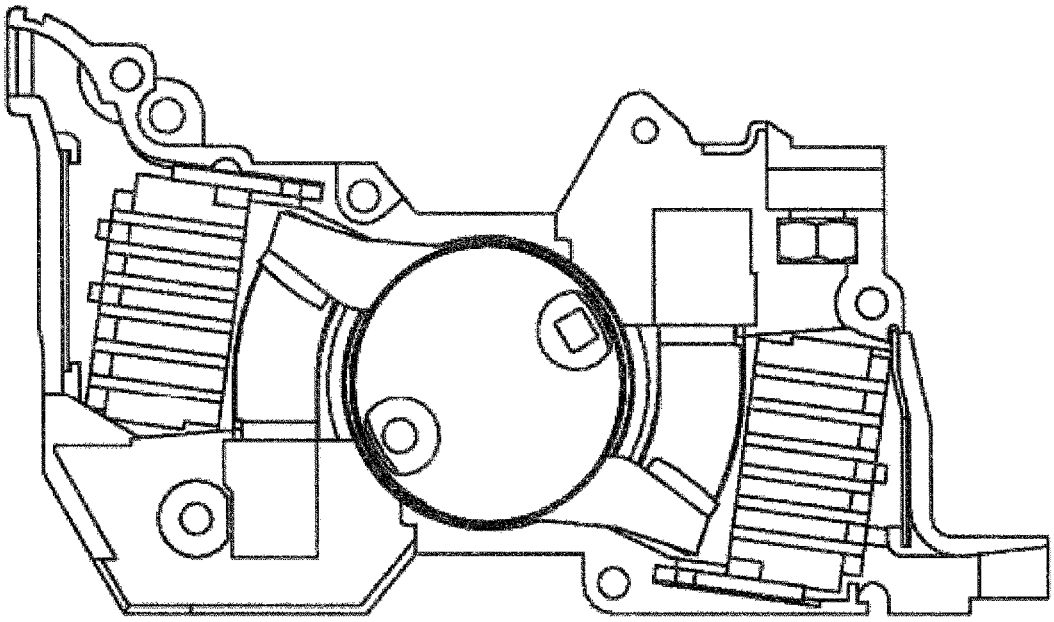
FIG. 9 illustrates a schematic diagram of a rotating dual break point contact according to an embodiment of the present invention, wherein a circuit breaker is at a maximum repulsion position.

When large current passes through a circuit breaker, the contact bridge rotates clockwise very fast under an electro-dynamic repulsion force generated between contacts. When the electro-dynamic repulsion force is large enough, the contact bridge rotates clockwise and goes over a dead point of the circuit breaker. FIG. 8 illustrates a schematic diagram of a rotating dual break point contact according to an embodiment of the present invention, wherein a circuit breaker is at a dead point. The first connection rod receives a spring force during the rotation, when the contact bridge rotates over the dead point, the spring force received by the first connection changes is direction from anti-clockwise to clockwise. The clockwise spring force is transferred to the contact bridge via the four rod linkage mechanism formed by the first connection rod, the second connection rod and the contact bridge. The clockwise rotation of the contact bridge is accelerated by the spring force to make the contact bridge leave away from static contacts. The contact bridge finally reaches the maximum repulsion position, backside of the profile of the contact bridge contacts with the lateral shaft on the rotor support, or in other words, the curved surface on the contact bridge contacts with the cylindrical surface on the lateral shaft. The circuit breaker is broken. FIG. 9 illustrates a schematic diagram of a rotating dual break point contact according to an embodiment of the present invention, wherein a circuit breaker is at a maximum repulsion position. The rotating dual break point contact may break the circuit breaker without an action of the operation mechanism, so that a minimal breaking time of a circuit breaker may be reduced significantly.

According to the embodiments of the present invention, the rotating dual break point contact comprises two contact structures on different sides of the contact bridge, the two contact structures shall be centrosymmetric. However, when the two contact structures are no longer centrosymmetric due to dimension or position deviation, the contact bridge shall have a self-adjustment ability so as to keep balance of the contact pressure on both sides and maintain the contact pressure at a desired level. The self-adjustment ability of the contact bridge is realized by providing the contact bridge with high degrees of freedom in a plane perpendicular to an axial of the rotor support. The obround hole in the contact bridge allows the rotation center of the contact bridge be deviated from the rotation center of the rotor support. The rotation center of the contact bridge may shift along the longitudinal direction of the obround hole so that the contact pressure on different sides is adjusted. The amount of adjustment is determined by an angle between the longitudinal direction of the obround hole and a welding surface of the contacts. The angle may be changed within a range where the welding surface is parallel to the longitudinal direction and the welding surface is perpendicular to the welding surface. The contact pressure difference between two sides presents a normal distribution, which means that an optimal equilibrium point exists. At the optimal equilibrium point, the contact bridge may have the best adjusting ability for balancing the contact pressure on different sides.

The rotating dual break point contact of the present invention has a simple structure and high reliability. The contact pressure on both sides of the contact bridge is balanced via an included angle between an obround hole and contact points. A single spring is utilized so that the rotating dual break point contact has a compact structure and small volume.

The above embodiments are provided to those skilled in the art to realize or use the invention, under the condition that various modifications or changes being made by those skilled in the art without departing the spirit and principle of the invention, the above embodiments may be modified and changed variously, therefore the protection scope of the invention is not limited by the above embodiments, rather, it should conform to the maximum scope of the innovative features mentioned in the Claims.

What is claimed is:

1. A rotating dual break point contact comprising: a rotor support, a first shaft, a second shaft, a third shaft, a first connection rod, a second connection rod, a contact bridge and a single contact spring, wherein the contact bridge is provided in the rotor support, the contact bridge rotates relative to the rotor support by means of the first shaft, the second shaft, the third shaft, the first connection rod and the second connection rod, the contact bridge rotates between an initial pressure position and a maximum repulsion position;

the single contact spring is mounted on one side of the contact bridge and is located in the rotor support.

2. The rotating dual break point contact according to claim 1, wherein the rotor support is single phase independent, the rotor support comprises two side plates and two lateral shafts which connect the two side plates, the two side plates are uniform in shape and size, the two side plates have a gap therebetween which is sufficient for the contact bridge to pass through, the two lateral shafts are centrosymmetric; each side plate is provided with a central hole in the center, each side plate is provided with a pair of centrosymmetric linkage holes and a pair of centrosymmetric connection slots, wherein the pair of linkage holes are disposed on two ends of the major axis of the side plate respectively, and the pair of the connection slots are disposed on two ends of the minor axis of the side plate respectively;

two first connection rods are mounted between the two side plates and are arranged on different sides of the contact bridge, the first connection rod is provided with a short shaft, the short shaft is mounted in the connection slot, the short shaft is the rotation center of the first connection rod;

two second connection rods are mounted between the two side plates and are arranged on different sides of the contact bridge;

the contact bridge is centrosymmetric in cross section, the contact bridge is provided with an obround hole in the center, the first shaft passes through the obround hole and slides therein along a longitudinal direction of the obround hole, the first shaft is the rotation center of the contact bridge when the first shaft slides to one end of the obround hole, the contact bridge is provided with a pair of centrosymmetric curved surfaces and a pair of centrosymmetric through holes, two curved surfaces cooperate with two lateral shafts to constrain the rotation range of the contact bridge, two third shafts pass through two through holes respectively; the contact bridge is provided with two contact points on each side, the two contact points are welded to a contact, the longitudinal direction of the obround hole and a line connecting the two contact points form an included angle, which keeps balance of the contact pressure of the contact points on both sides of the contact bridge;

the first shaft passes through the obround hole on the contact bridge and the central hole on the side plate;

two second shafts respectively pass through the first connection rod and the second connection rod and are mounted on profile of the two side plates, the two second shafts are arranged centrosymmetrically;

two third shafts respectively pass through the through hole on the contact bridge and the second connection rod, the two third shafts are arranged centrosymmetrically;

two ends of the single contact spring are mounted on two second shafts respectively.

3. The rotating dual break point contact according to claim 2, wherein the central holes on the two side plates are aligned;

the linkage holes on the two side plates are aligned;

the connection slots on the two side plates are aligned;

the first shaft cooperates with the central hole by means of a minuteness gap.

4. The rotating dual break point contact according to claim 3, wherein a plurality of contact modules with the rotating dual break point contact are cascaded to form a multi-phase contact module, a linkage shaft is mounted in the linkage holes to realize linkage of the multi-phase contact module.

5. The rotating dual break point contact according to claim 2, wherein a cylindrical surface on the lateral shaft cooperates with the curved surface on the contact bridge, two lateral shafts correspond to the initial pressure position and the maximum repulsion position of the contact bridge respectively, the cylindrical surface on the lateral shaft cooperates with the curved surface by means of a minuteness gap.

6. The rotating dual break point contact according to claim 5, wherein a plurality of contact modules with the rotating dual break point contact are cascaded to form a multi-phase contact module, a linkage shaft is mounted in the linkage holes to realize linkage of the multi-phase contact module.

7. The rotating dual break point contact according to claim 2, wherein the first connection rod comprises a body and two terminal surfaces laterally extending from both ends of the body, each terminal surface is provided with a convex short shaft and a first shaft hole, the short shaft and the first shaft hole are symmetric about the body on the terminal surface; the short shaft cooperates with the connection slot by means of a minuteness gap.

8. The rotating dual break point contact according to claim 7, wherein the second connection rod comprises a body and two terminal surfaces laterally extending from both ends of the body, each terminal surface is provided with a second shaft hole and a third shaft hole, the second shaft hole and the third shaft hole are symmetric about the body on the terminal surface.

9. The rotating dual break point contact according to claim 8, wherein the side plate is provided with a groove slot, the second shaft passes through the first shaft hole on the first connection rod and the second shaft hole on the second connection rod, the second shaft is mounted on the groove slot;

the second shaft cooperates with the first shaft hole and the second shaft hole by means of minuteness gaps respectively.

10. The rotating dual break point contact according to claim 9, wherein the third shaft passes through the third shaft hole on the second connection rod, the third shaft cooperates with the third shaft hole by means of a minuteness gap.

11. The rotating dual break point contact according to claim 9, wherein a plurality of contact modules with the rotating dual break point contact are cascaded to form a multi-phase contact module, a linkage shaft is mounted in the linkage holes to realize linkage of the multi-phase contact module.

12. The rotating dual break point contact according to claim 10, wherein a plurality of contact modules with the rotating dual break point contact are cascaded to form a multi-phase contact module, a linkage shaft is mounted in the linkage holes to realize linkage of the multi-phase contact module.

13. The rotating dual break point contact according to claim 8, wherein a plurality of contact modules with the rotating dual break point contact are cascaded to form a multi-phase contact module, a linkage shaft is mounted in the linkage holes to realize linkage of the multi-phase contact module.

14. The rotating dual break point contact according to claim 7, wherein a plurality of contact modules with the rotating dual break point contact are cascaded to form a multi-phase contact module, a linkage shaft is mounted in the linkage holes to realize linkage of the multi-phase contact module.

15. The rotating dual break point contact according to claim 2, wherein the rotor support is provided with a connection rod slot and a spring slot on both side plates, a depth of the connection rod slot is not smaller than a thickness of the body of the first connection rod, the body enters into the connection rod slot when the first connection rod rotates, the contact spring is able to move in the spring slot.

16. The rotating dual break point contact according to claim 15, wherein a plurality of contact modules with the rotating dual break point contact are cascaded to form a multi-phase contact module, a linkage shaft is mounted in the linkage holes to realize linkage of the multi-phase contact module.

17. The rotating dual break point contact according to claim 2, wherein a plurality of contact modules with the rotating dual break point contact are cascaded to form a multi-phase contact module, a linkage shaft is mounted in the linkage holes to realize linkage of the multi-phase contact module.

18. The rotating dual break point contact according to claim 1, wherein a plurality of contact modules with the rotating dual break point contact are cascaded to form a multi-phase contact module, a linkage shaft is mounted in the linkage holes to realize linkage of the multi-phase contact module.

* * * * *